US006371832B1

(12) United States Patent
Raguse

(10) Patent No.: US 6,371,832 B1
(45) Date of Patent: Apr. 16, 2002

(54) PARTICULATE BONDING PROCESS AND PRODUCTS MADE ACCORDING TO THE PROCESS

(76) Inventor: Roger C. Raguse, 4480 Cedar Cove, Troy, OH (US) 45373

( * ) Notice: Subject to any disclaimer, the term of this patent is extended or adjusted under 35 U.S.C. 154(b) by 0 days.

(21) Appl. No.: 09/669,809

(22) Filed: Sep. 20, 2000

Related U.S. Application Data

(60) Provisional application No. 60/155,476, filed on Sep. 23, 1999.

(51) Int. Cl.[7] ..... B24B 1/00

(52) U.S. Cl. ..... 451/28; 451/526; 451/533; 451/56

(58) Field of Search ..... 451/28, 41, 56, 451/526, 538, 539, 533, 529; 428/457, 94; 427/372.2, 374.1, 154–156

(56) References Cited

U.S. PATENT DOCUMENTS 3,808,017 A * 4/1974 Bath et al. ..... 106/214
5,242,755 A * 9/1993 Keller et al. ..... 428/457
5,692,949 A * 12/1997 Sheffield et al. ..... 451/538
5,840,141 A * 11/1998 Korbel ..... 156/153

* cited by examiner

*Primary Examiner*—Derris H. Banks
(74) *Attorney, Agent, or Firm*—William Weigl

(57) ABSTRACT

An environmentally-safe heat-reactive curable melt adhesive in fine crystalline powder form is mixed with any of a large variety of compatible particulate materials and heated to a predetermined temperature for a predetermined time during which the powder liquifies and cross links. The preliminary mixture can be accomplished by gentle tumbling, and in the process, the powder crystals cling to the particles. Upon subsequent cooling, the powder adhesive cross link bonds the particles to each other and/or to each other and to a supporting member or surface. Application of pressure at the time of heating is particularly useful where the end product has some thickness. A grinding wheel can be made by sifting the dry mixture through a soft non-woven pad until its interstices are essentially filled. The pad is then placed under pressure during the heating process.

14 Claims, 3 Drawing Sheets

PARTICULATE BONDING PROCESS AND PRODUCTS MADE ACCORDING TO THE PROCESS

This application is based on my U.S. Provisional Patent Application Ser. No. 60/155,476 filed Sep. 23, 1999.

This invention relates to a novel process of bonding particles of various materials to each other and/or to a supporting surface or member, and to articles produced according to the process.

BACKGROUND OF THE INVENTION

At various times in the history of making abrasive material commonly referred to as "sandpaper" by the general public, adhesives used to adhere the abrasive grit to a backing sheet material have gone from using natural glue type materials to various kinds of artificial resins and epoxy materials. Typically, most adhesive materials used today require the liquification of an adhesive that is usually applied to a backing sheet. This is usually done by employing various environmentally-unfriendly solvents. These solvents are not only messy to handle, but are at times unsafe for the personnel using them. In addition, state and federal laws frequently require that the solvents not be released into the atmosphere, thus requiring that a manufacturing process further include expensive equipment for preventing such release and, in some instances, reclaiming the captured substance. Certain hot melt adhesive processes have also been considered to eliminate solvent usage, but to my knowledge, are not in common use.

Conventional manufacture of abrasive sheet material requires expensive equipment occupying considerable space and auxiliary equipment for handling solvent flashing. The advantages of being able to provide low cost, low volume manufacture of abrasive sheet material in a relatively safe environment is apparent.

SUMMARY OF THE INVENTION

The invention relates to an environmentally-safe heat-reactive curable melt adhesive in fine crystalline powder form, its mixture with any of a large variety of compatible particulate materials and heating the mixture to a predetermined temperature for a predetermined time during which the powder liquifies and cross links. The preliminary mixture can be accomplished by gentle tumbling, and in the process, the powder crystals cling to the particles. Upon subsequent cooling, the powder adhesive bonds the particles to each other and/or to each other and to a supporting member or surface. Application of pressure at the time of heating is particularly useful where the end product has some thickness.

DESCRIPTION OF THE PREFERRED PROCESS AND PRODUCTS

Although the process can be used for producing a large variety of products, certain ones of which will be discussed below, this disclosure will concentrate mainly on a description of manufacturing abrasive sheet material and abrasive grinding tools. It will be obvious from the description of producing these products that there are many applications of the process to many different and totally unrelated products. Some products are best suited to being supported by a member or surface, while others may require only a particulate material and the powdered adhesive, i.e., be self-sustaining without requiring a support or supporting surface.

Figure 1:
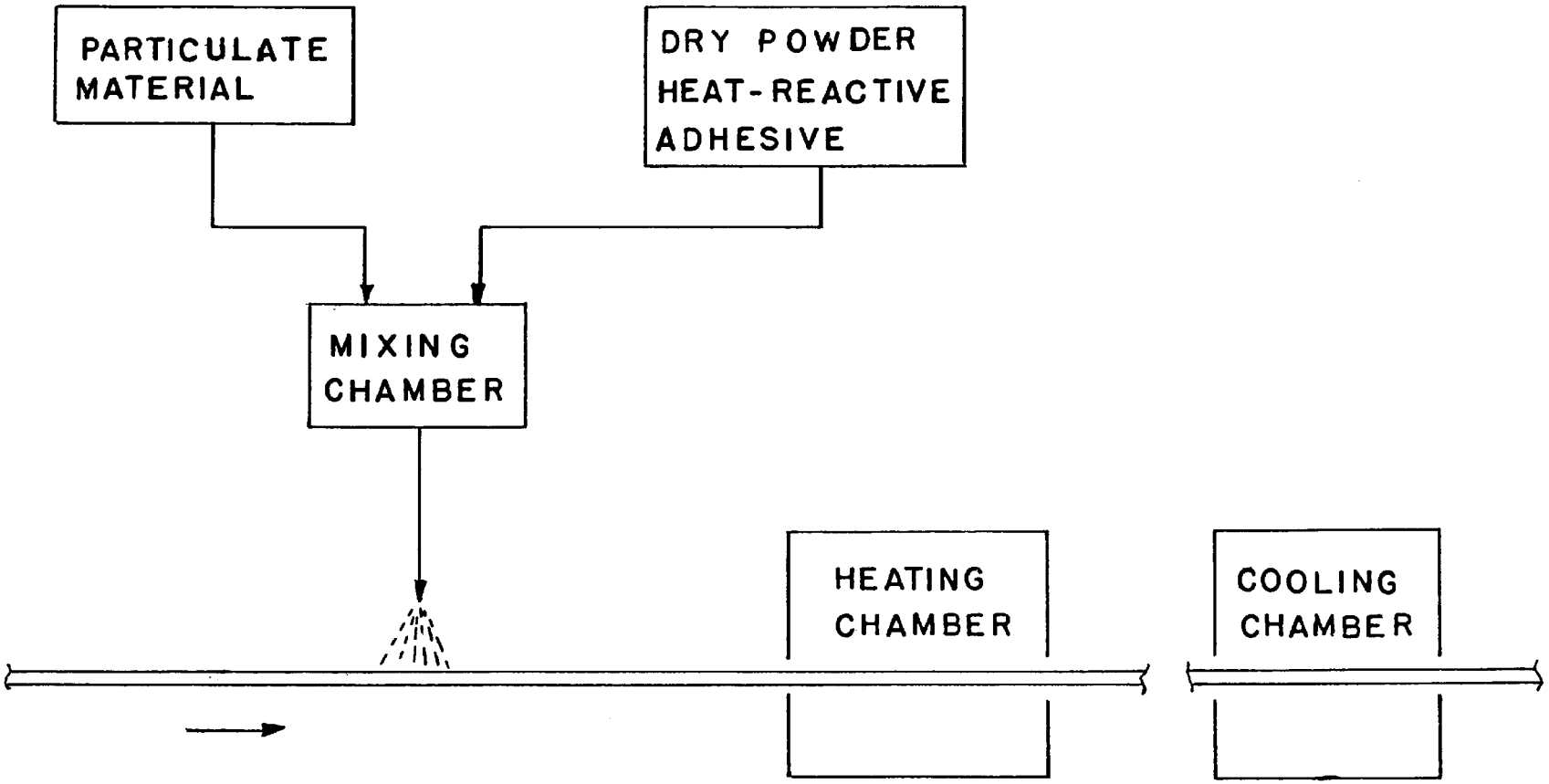
FIG. 1 is a simplified flow chart illustrating one potential use of the concept in the manufacture of a roll or sheet of flexible abrasive stock.
Figure 5:
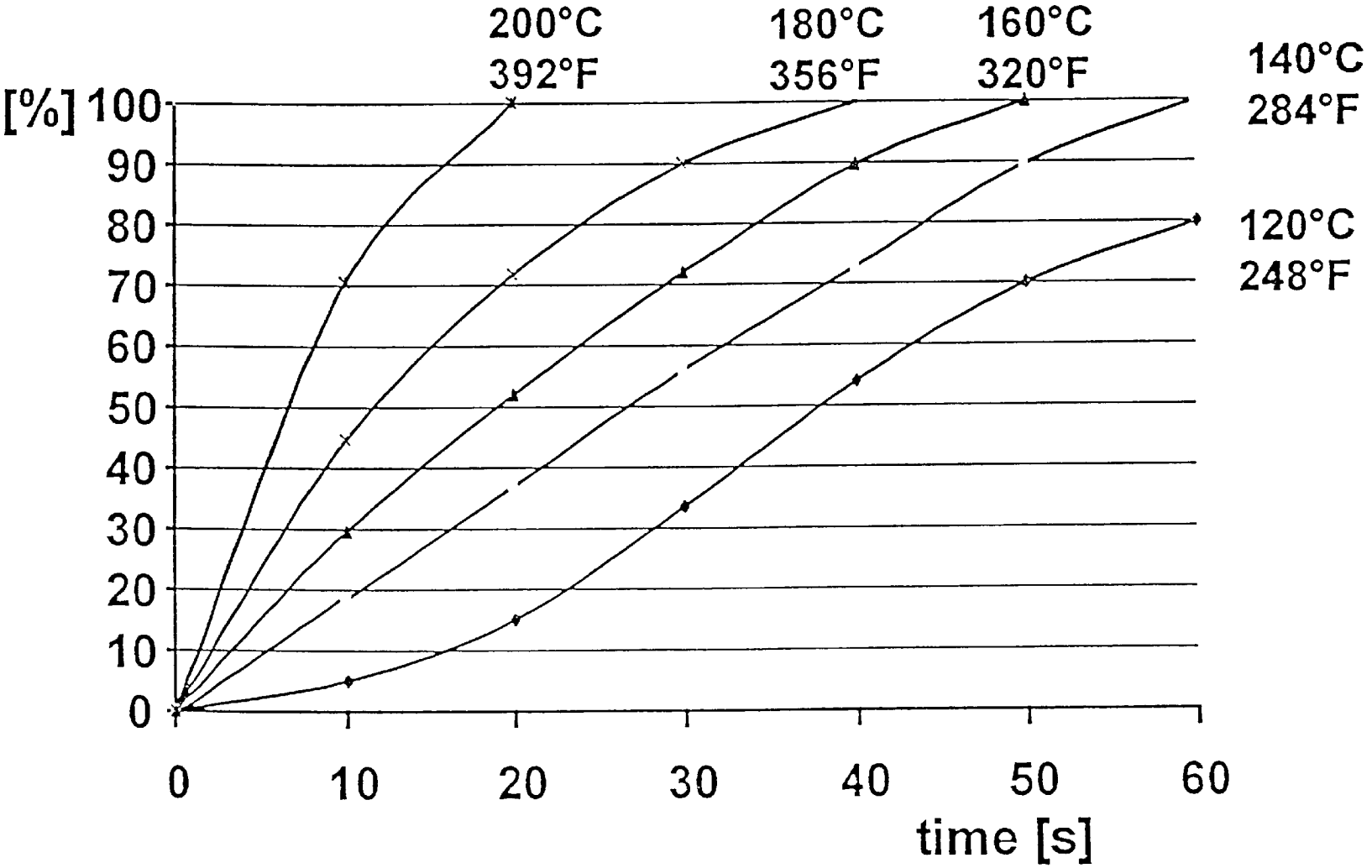
FIG. 5 is a copy of a time/temperature chart supplied by the U.S. distributor of the preferred adhesive used in the process.

FIG. 1 illustrates the steps of the process in producing abrasive material in sheets of indeterminate lengths. First the abrasive grit and the adhesive powder are provided separately. For example the grit may be #60, and the preferred adhesive is cross-linked Purbond HCM VN 555, believed to be manufactured by Ebnother AG of Industriegebeit Rank, CH-6203 Sempach-Station. Its particle size is what the manufacturer calls Type C, less than 150 micromillimeters. Its consistency is similar to that of baking flour. The product is a polyester-polyurethane that may be applied to a surface at temperatures of 140–150F. (60–70C.), heat-activated above 212 F. (100 C.) and heat-reactivated between 266 (130 C.) and 302F. (150 C.) with cross linking occurring during a 10 to 60 second exposure temperature. The chart of FIG. 5 illustrates the various temperatures and times provided by its U.S. supplier, Collano, Inc of Southfield, Mich. Its primary and only known use to this date has been in the automotive field for lamination of textiles and films, PVC, artificial leather and various other sandwich composites. One example provided by the supplier is in fabric adhesion for automobile door panels. This particular Purbond adhesive is resistant to most plasticizers and provides heat resistance up to 356 F. Above that temperature, the adhesive decomposes, enabling the debonding and recycling of stock, possibly resulting in materials savings, although this has not yet been explored. Certain abrasive grits are quite expensive, e.g., diamond dust, and enabling reuse of the grit from a worn abrasive diamond tool could result in substantial manufacturing economies.

In attempting to see whether the adhesive had capabilities for causing adherence of abrasive grit to a backing stock, I took a small quantity of grit and mixed it with the powder. I was quite surprised to see how readily and uniformly they combined, almost as though they were electrostatically attracted. I placed a thin layer of the mixture on the backing, heated it to the reactivation temperature suggested by the manufacturer and found that it made a fairly good abrasive sheet. The mixture was made by simply gently tumbling the grit and powder in a paper cup. I have been successful thus far in combining a ratio of 85–95% grit with 5–15% adhesive by weight. These percentages will no doubt vary according to the particulate material that is used.

Figure 2:
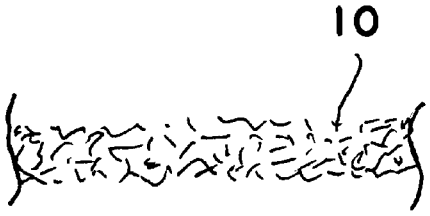
FIGS. 2–4 are three additional steps performed in the manufacture of an abrasive grinding wheel or disc.
Figure 3:
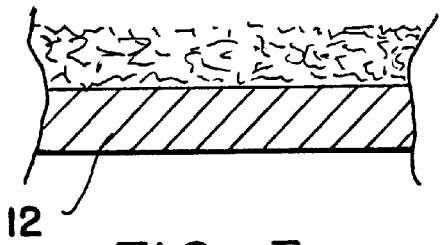
Figure 4:
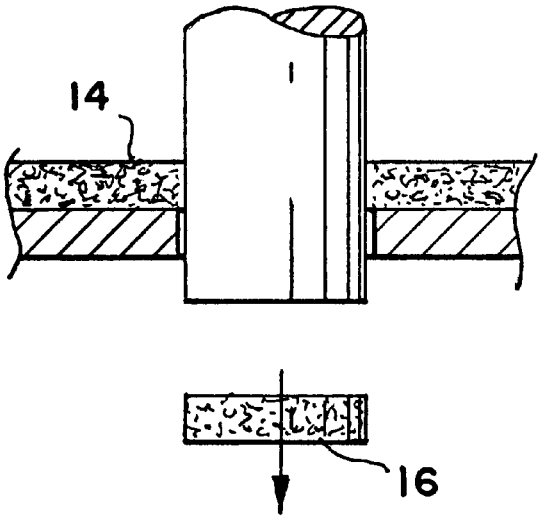

I subsequently formed globs of the grit/powder mixture on a release backing, effectively illustrating that it was capable of being cast independently of a supporting member or structure such as a backing stock. Still later I found that application of pressure at the time of heating resulted in samples that indicated the process is useful for making grinding wheels or discs. From there I proceeded to make grinding discs of the type illustrated in FIGS. 2–4. A fairly recent and highly successful disc on the market is the so-called "non-woven" type manufactured by the 3M Company of Minneapolis, Minn. I proceeded to find a soft fibrous mesh buffing pad 10 of about one fourth inch in thickness. The pad used was the "fibral" stock supplied by Freudenberg Vliesstoffe KG of Halifax, West Yorkshire, England. It has interstices slightly larger than the #60 grit size I was using at the time. After mixing the grit and adhesive, I placed the pad 10 on a plate 12 having a topside release surface coated with silicone. I began slowly pouring the mixture on the top of the pad 10, letting it sift through the interstices until I was certain enough had gone fully through to reach the bottom. I jostled the pad a little to aid the sifting. I believe that some of the adhesive powder collected by the grit may actually attach to the fibers of the pad 10 while still dry, but have not yet examined this closely. After the mesh pad 10 had appeared to be filled with the mixture, a release-coated plate (not shown) was placed over the pad, and the pad and adhesive were compressed to 2000# psi for 30 seconds while subjecting them to a temperature of 300 F. The pad and mixture compressed to a flat stock of approximately 3⁄16 ths of an inch in thickness. The stock was cooled and resulted in a hard abrasive plate 14. The abrasive plate 14 was taken to a standard punch press and stamped into a circular disc 16. The disc was subsequently mounted on a rotary tool and used to successfully abrade and polish various items. Rather than punch the discs to their end shapes, it is possible to mold them to their final shape. Or, the pad may be made circular and approximately of the desired end diameter to begin with. After forming, the edges can be trimmed in a punch or left "as is" if the discs are suitable for their express needs in that fashion. Either of the latter two techniques could allow substantial savings by reducing waste stock, as well as minimizing or eliminating the cost, wear-and-tear and maintenance of punching or comparable tools.

Figure 6:
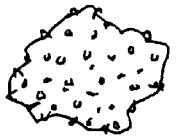
FIG. 6 is a highly enlarged view of a single abrasive granule with minute crystals of the preferred adhesive as they appear under a 30× power microscope.

To the naked eye, the grit first appeared to be encapsulated in the powder. Upon examination under a 30× power microscope, however, the individual granules appeared as shown in FIG. 6. While I cannot be certain, the fine crystals of the adhesive seemed to stand out on individual grit granules almost as though they were electrostatically adhering to the granules. When the tip of a pair of scissors was brought into contact with the coated granules, some of the adhesive crystals clung to the edge of the scissors tips and extended almost radially outward, again suggesting the possibility of electrostatic attraction. This remains to be studied.

The preferred powdered adhesive was also tried with various other products, each time mixing the particulate material and adhesive powder prior to heating and curing. Some potential other uses of which samples were made are:

Particle Building Board: wood particles or other cellulose product can be pressed into thin sheets and used in the construction industry.

Emery Board: flat wood or plastic sticks can have abrasive applied to their exteriors and used for filing fingernails, for example. The sticks may or may not require pre-wetting to cause the mixture to adhere to the sticks prior to heating.

Anti-skid surfaces: mixture of various types of grits and the adhesive powder can be applied to various surfaces such as stair treads, etc.

Ceramics: various types of inorganic material such as sand, finely ground grit, diatomaceous earth and other media can be mixed with the adhesive and poured into release-coated molds. The molds are then heated, allowed to cool and the cast end product removed.

Pumice stone: mixture of powdered adhesive and soft abrasive material could be formed into a device that could be used to remove calluses and other skin surfaces where pumice stone is presently used.

Fireplace logs: mixed product can be pressure-formed into logs or other shapes for use in stoves, fireplaces or wood-burning furnaces.

All of these samples and many others not yet explored utilize the feature of premixing the fine crystalline adhesive and particulate material in predetermined ratio ranges found most appropriate for the particular material, then heating the combination, with or without a supporting member or surface and with or without pressure being applied, for predetermined times at predetermined temperatures. The claims encompass compatible particulate material and powdered adhesive employed in the same manner and process. The mesh pad 10 may be of any material, including furnace filter media.

Various changes may be made without departing from the spirit and scope of the invention.

Having described my invention, I claim:

1. The process of applying of particulate material particles to each other comprising the steps of:

a. providing a predetermined volume of free, loose particulate material;

b. providing a predetermined volume of dry heat cure melt adhesive in fine powder form;

c. mixing the particulate material with the dry powder adhesive;

d. heating the mixture to a temperature at which the powder liquifies and flows to essentially combine touching particles of the material to each other; and e. cooling the material to cause the adhesive to set.

2. The process according to claim 1 wherein the particulate material is placed under pressure during the heating process.

3. A product made according to the process of claim 2 wherein said tool is a grinding wheel.

4. A product made according to the process of claim 3 wherein said grinding wheel consists of a non-woven mesh material having interstices exceeding the particle size of said material and wherein said mixture of particles and powder adhesive are distributed essentially throughout the interstices.

5. A product made according to the process of claim 2 wherein said particulate material is a cellulose material and said product is made in sheet form.

6. A product made according to the process of claim 1 wherein said particulate material is an abrasive grit and wherein the product consists of an abrasive tool.

7. A product made according to the process of claim 1 wherein said particulate material consists of grains of sand and said process further includes the step of pouring the mixture, while dry, in a release-coated mold.

8. A product made according to the process of claim 1 wherein said particulate material consists of a diatomaceous material and said process further includes the step of pouring the mixture, while dry, in a mold.

9. The process of applying particulate material to a supporting member comprising the steps of:

a. providing a predetermined volume of free, loose particulate material;

b. providing a predetermined volume of dry heat cure melt adhesive in fine powder form;

c. mixing the particulate material with the dry adhesive;

d. placing the combined mixture on the supporting member;

e. heating the supporting member and the mixture to a temperature at which said powder liquifies and flows to essentially combine touching particles of the material to each other and to the supporting member; and f. cooling the supporting member and the material to cause the adhesive to set and secure the particulate material to the supporting member.

10. The process according to claim 9 wherein said mixing is accomplished through gentle agitation to essentially encapture individual particles with crystals of the adhesive powder.

11. The process according to claim 10 wherein the particulate material and surface are placed under pressure during the heating process.

12. The process according to claim 11 wherein the supporting member includes the step of providing a mesh material having interstices exceeding the size of said particulate material and wherein the process includes the further step of sifting the combined mixture of particulate material and dry adhesive by gravity through said mesh material to essentially fill the interstices prior to heating.

13. A grinding wheel produced according to the process of claim 12.

14. An abrasive sheet produced according to the process of claim 9.

* * * * *